United States Patent [19]

Klaser

[11] 4,324,388

[45] Apr. 13, 1982

[54] FENCE STRUCTURE

[76] Inventor: William A. Klaser, 1619 Lincoln Ave., Evansville, Ind. 47714

[21] Appl. No.: 200,926

[22] Filed: Oct. 27, 1980

[51] Int. Cl.[3] ..... E04H 17/14

[52] U.S. Cl. ..... 256/19; 256/13.1; 256/66; 52/165

[58] Field of Search ..... 256/19, 66, 65, 72, 256/60, 13.1; 52/165, 155

[56] References Cited

U.S. PATENT DOCUMENTS

| | | | |
|---|---|---|---|
| 96,934 | 11/1869 | Lowe | 256/66 |
| 199,949 | 2/1878 | Youngs | 52/165 |
| 220,683 | 10/1879 | Truxell | 256/60 |
| 516,232 | 3/1894 | Sliker | 256/72 |
| 642,011 | 1/1900 | Sill | 256/65 |
| 799,413 | 9/1905 | Spencer | 256/DIG. 4 |
| 3,066,447 | 12/1962 | Reiterer et al. | 52/155 X |
| 3,891,189 | 6/1975 | Russo | 256/19 X |
| 3,955,801 | 5/1976 | Soriero, Jr. | 256/65 |

*Primary Examiner*—Andrew V. Kundrat
*Attorney, Agent, or Firm*—Warren D. Flackbert

[57] ABSTRACT

A fence structure wherein the components are fabricated from a plastic resin and where the corner, line or gate posts present positive anchoring with ready installation. The fence structure is versatile in styling and appearance, serving to satisfy both decorative and utilitarian needs.

3 Claims, 7 Drawing Figures

FENCE STRUCTURE

The popularity of fences is ever expanding, but the need for improvements to what is presently available is continually recognized by the user. In this connection, present day fences require considerable maintenance in the form of painting, staining, post replacement due to rotting of materials and, as well, rebuilding occasioned by everyday activities. Additionally, fences on the market typically require tedious installation as, for example, in the digging of the holes for the posts, the mixing of material into which the posts are embedded, and the like.

The invention serves to overcome the preceding difficulties in presenting a fence fabricated from a plastic resin, such being light in weight, physically strong, washable and virtually weatherproof. The posts utilized in the invention are each seated in an anchor which is readily driven into the ground in a fashion similar to a splined stake.

The fence structure presented herein lends itself to various installations and/or styling. In this connection, and by way of example, the resulting fence may present a conventional picket, plank or split rail form, the components of each being fabricated from the aforesaid plastic resin and readily assembled through direct fastening or a slip-fit relationship.

Additionally, the fence post with associated cap members may be varied to further the versatility of appearance in the finished arrangement, including changes in color or finish for the entire assembled fence. The fence of the invention serves utilitarian or functional purposes and, as well, ornamental and decorative usages.

In any event, a better understanding of the present invention will become more apparent from the following description, taken in conjunction with the accompanying drawing, wherein FIG. 1 is a view in side elevation of a fence post anchor in accordance with the teachings of the present invention;

Figure 1:
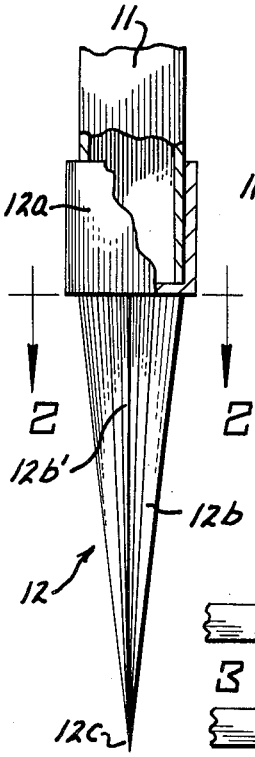

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications of the illustrated device and such further applications of the principles of the invention as illustrated therein being contemplated as would normally occur to one skilled in the art to which the invention relates.

Figure 2:
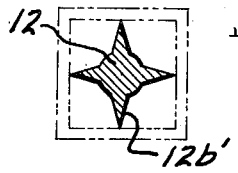
FIG. 2 is a view in horizontal section, taken at line 2—2 on FIG. 1 and looking in the direction of the arrows, showing further details of the fence post anchor.

Referring now to the figures, and particularly to FIGS. 1 and 2, an important feature of the invention is the presentation of a post anchor 12, defined by a post receiving portion 12*a*, typically square in plan configuration, having a downwardly and inwardly tapering lower portion 12*b* terminating at a point 12*c*. As evident in FIG. 2, the outer surface of the downwardly and inwardly tapering lower portion 12*b* is representatively defined by longitudinal inwardly tapering vanes 12*b'*, such serving stability purposes upon installation.

The post anchor 12 is fabricated from a plastic resin and the physical characteristics thereof permit, as should be evident, easy driving into a desired location for the fence under erection. Restated otherwise, the post anchors 12 preclude any necessity of digging and the use of concrete or like embedding material as is presently the instance. An incident of the preceding is the elimination of mixing and the continual need for embedding material as the installation procedure progresses.

Figure 5:
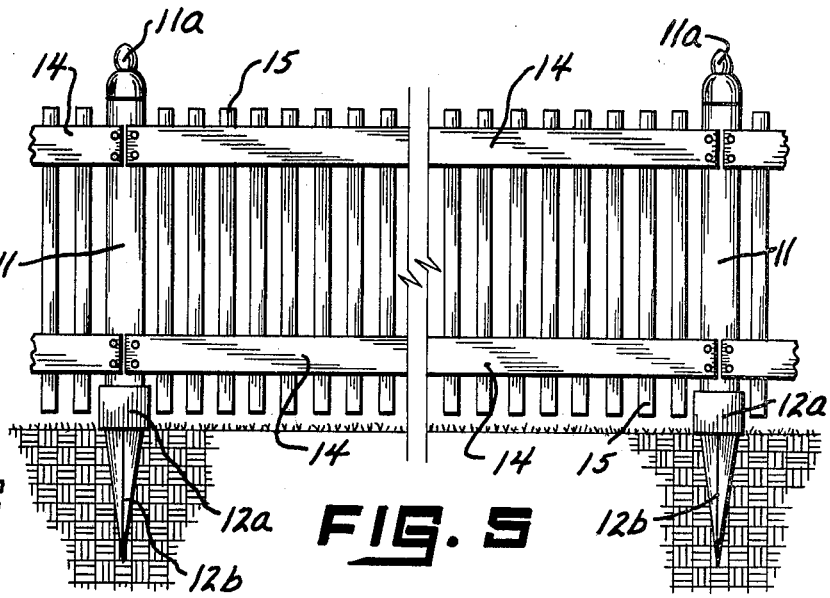
FIG. 5 is a view in side elevation, illustrating a finished picket fence in accordance with the teachings of the invention.
Figure 6:
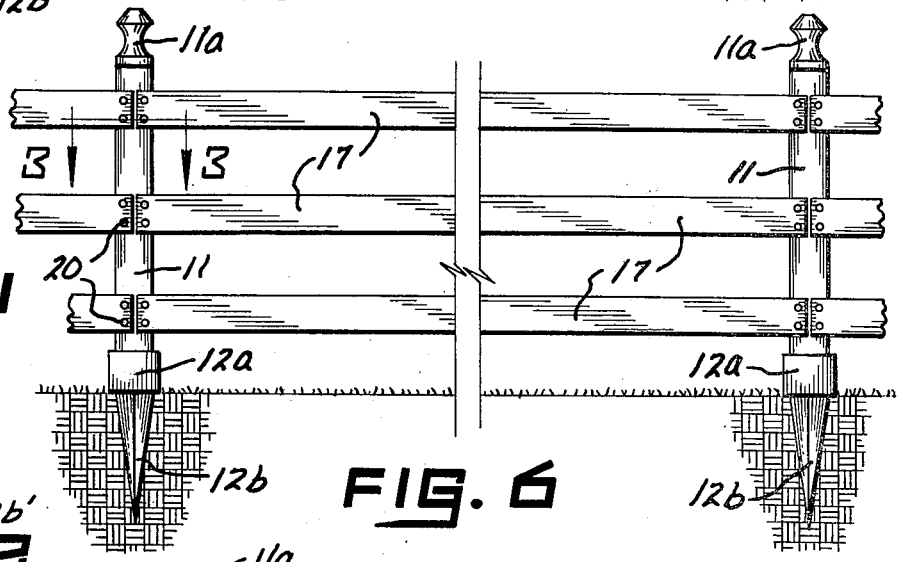
FIG. 6 is another view in side elevation, in this instance illustrating a plank fence in accordance with the teachings of the present invention; and, FIG. 7 is still another view in side elevation, in this instance illustrating a split rail form of fence in accordance with the teachings of the present invention.
Figure 7:
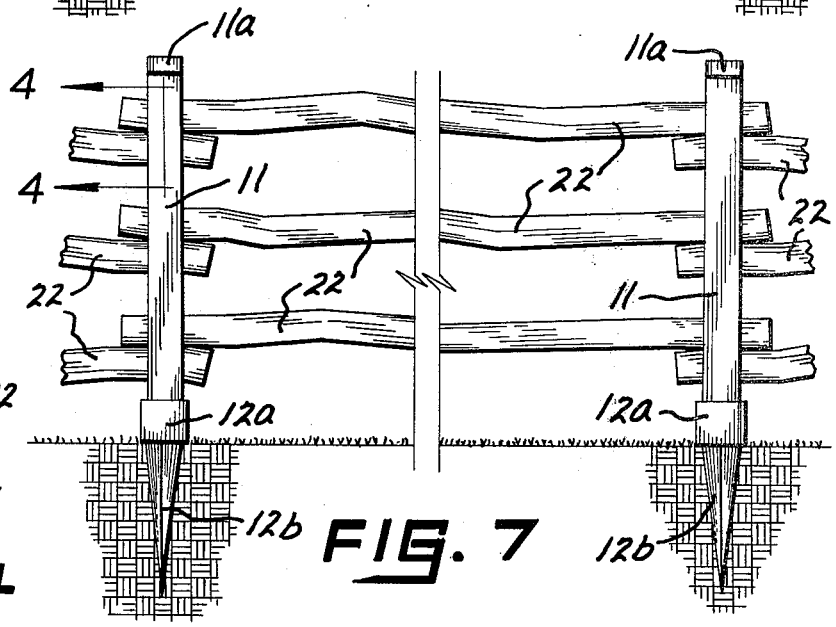

FIGS. 5, 6 and 7 illustrate fence structures in accordance with the teachings of the invention, where each of the components, i.e. the fence post 11, the horizontal rails 14 and the vertical pickets 15, in the instance of the FIG. 5 showing, are fabricated from a plastic resin. In order to even further illustrate the versatility of the invention, cap members 11*a* for the fence posts 11 may present different ornamental appearances, where those illustrated in FIGS. 5, 6 and 7 are representative.

In any event, and in installation, the post anchors 12 are driven into the ground or receiving area and, thereafter, the associated posts 11 slip into the receiving portion 12*a* of each. The posts 11 may serve corner, line or gate purposes. The rails 17, as planks (FIG. 6), or the rails 14 and vertical pickets 15 (FIG. 5) might be preassembled, at least in part, with each fence post 11 to expedite installation. In other words, the user has an option as to the mode of installation.

Figure 3:
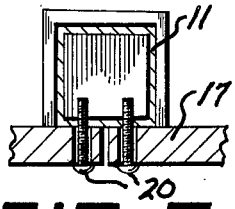
FIG. 3 is a view in horizontal section, taken at line 3—3 on FIG. 6 and looking in the direction of the arrows, showing a typical fastening arrangement between a fence rail and a fence post.
Figure 4:
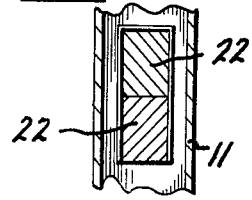
FIG. 4 is a view in vertical section, taken at line 4—4 on FIG. 7 and looking in the direction of the arrows, showing a typical assembly arrangement between rails and a fence post.

FIG. 3 shows, by way of example, one approach for securing a rail 17 to the fence post 11, i.e. with a bolt or bolts 20, although conventional "molly" fastening may be employed. Typically, holes or openings for each bolt 20 can be predrilled in the respective component for ready and uniform installation. On the other hand, FIG. 4 illustrates a slip-fit assembly between the fence post 11 and the split rails 22 of the fence form of FIG. 7. The latter assembly is indicative of the simplicity of erecting such type of fence once the post anchors 12 are easily driven, like stakes, at the desired locations.

From the preceding, it should be apparent that the invention affords a versatile and practical form of fence, for decorative, containment or privacy purposes, fabricated from components made from plastic resin, representing simplicity in installation and assembly. The usage of the plastic resin offers durability and strength, with a choice of ultimate color and largely weather resistant qualities. The fence, in various forms, adds realism to the location of usage and, as well, an important utilitarian function. The post anchor presents ease in fence location by merely requiring the dropping or slipping of the post into the receiving portion thereof. The shape of the lower portion of the post anchor is effective in driving such, as a splined stake, at the desired fence location.

The fence structure described hereabove is susceptible to various changes within the spirit of the invention as, for example, in the precise manner of assembling a rail to a fence post; the type of post cap utilized; the mentioned various esthetic changes available to the user; and, the like. The importance of the invention is primarily two-fold, to-wit the utilization of components fabricated from a plastic resin and the unique post anchors, with the latter being particularly advantageous in connection with the erection of a fence structure. In any event, the above description should be considered illustrative and not as limiting the scope of the following claims:

I claim:

1. A fence structure comprising, in combination, a fence post having an anchor, and rails interconnecting said fence post, where said fence post and said rails are fabricated from a plastic resin, and where said fence post is separable into a post anchor and a post, said post anchor having a lower cone portion extending downwardly and inwardly to a point and includes outwardly extending tapered flanges along the outer surfaces thereof and an upper polygonal portion socket slidably receiving said post on top of said cone and having a bottom wall extending radially beyond the largest diameter of said flanges.

2. The fence structure of claim 1 where said rails are selectively mounted on said fence post on an outer surface thereof.

3. The fence structure of claim 1 where said fence post includes openings on opposite faces thereof through which said rails extend in a supported relationship.

* * * * *